United States Patent [19]

La Ginestra

[11] 4,308,724

[45] Jan. 5, 1982

[54] RANDOMLY ACTIVATED OUTLET

[76] Inventor: Nicholas M. La Ginestra, 67 Diamond St., Elmont, Long Island, N.Y. 11003

[21] Appl. No.: 147,369

[22] Filed: May 5, 1980

[51] Int. Cl.[3] ..... F25B 49/00; G08B 17/00

[52] U.S. Cl. ..... 62/126; 340/585

[58] Field of Search ..... 62/125, 126; 165/11; 236/94; 340/656, 585; 315/100, 50; 362/92, 253, 276

[56] References Cited

U.S. PATENT DOCUMENTS 2,687,020 8/1954 Staebler et al. ..... 62/227

3,105,362 10/1963 Gould ..... 62/126

3,839,877 10/1974 Kramer ..... 62/126

*Primary Examiner*—William E. Wayner

*Assistant Examiner*—Harry Tanner

*Attorney, Agent, or Firm*—Clarence A. O'Brien; Harvey B. Jacobson

[57] ABSTRACT

An electrical outlet is connected in a parallel circuit to the compressor unit of a standard household refrigerator. A lamp can be connected to the outlet and will thus provide random lighting in the house in accordance with the on-off cycle of the refrigerator refrigeration unit thus giving the appearance that there is activity within the house to discourage burglars or the like.

1 Claim, 5 Drawing Figures

RANDOMLY ACTIVATED OUTLET

BACKGROUND OF THE INVENTION

1. Field of the Invention

This invention relates to devices designed for random actuation of electrical components for the purpose of simulating activity within a building.

2. Discussion of Related Art

It is well known that the incidence of home burglaries is reduced when the home is actively occupied. Burglars are less likely to enter a home knowing that people are present on the premises than if it is known that the individuals are gone for an extended length of time. Accordingly, it is desirable when leaving a home unattended for an extended length of time to provide some means of indicating apparent activity in the home. One method of providing this result comprises the use of a preprogrammed electric timer which can turn on and off electrical appliances such as radios, lamps or the like during the same period each day. One problem encountered with the use of such timers is that the preprogrammed sequence is unchanging and can become apparent to one observing a home left for a long period of time. Accordingly, some device is needed which can easily and conveniently vary the cycle of operation of electrical appliances in the home.

Other control devices for electrical equipment are also known. For instance, U.S. Pat. No. 2,480,827, issued Sept. 6, 1949 to Armstrong, shows a detachable thermostat system having an electrical receptacle to be plugged into an existing wall outlet. The receptacle comprises a switch component operated by an attached thermostat. The receptacle can be used for control of electric heaters or the like for heating a room. U.S. Pat. No. 2,674,701, issued Apr. 6, 1954 to Maseritz, shows an electrical control unit having a plug to be inserted into an existing electrical outlet. The unit is provided with a receptacle into which may be plugged the device to be controlled with control established remotely by connecting an electric switch, thermostat, clock, timer or other control mechanism with the circuit contained in the control unit.

SUMMARY OF THE INVENTION

One object of the present invention is to provide an outlet which is to be actuated on a relatively random basis for providing an indication of apparent activity in a home or other structure.

A further object of the present invention is to provide a randomly activated outlet which is run off an existing appliance so as to provide an outlet which is inexpensive to install yet effective and safe in operation.

In accordance with the above objects, the randomly activated outlet of the present invention comprises a standardly available electrical socket which is mounted in an external wall of a standard refrigerator. The socket is wired so as to be in parallel with the compressor motor of the refrigerator. Accordingly, whenever the thermostat of the refrigerator commands a cycle of the compressor, electrical power is applied to the connected socket. Thus, any appliance such as a lamp, radio, television or the like which is connected to the socket will be activated also. The cycling of a standard refrigerator is somewhat random and lasts for varying periods of time. Therefore, any such electrical appliance connected to the randomly activated socket will likewise be operated on a somewhat random basis thereby giving the impression to a casual observer that the home is occupied.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
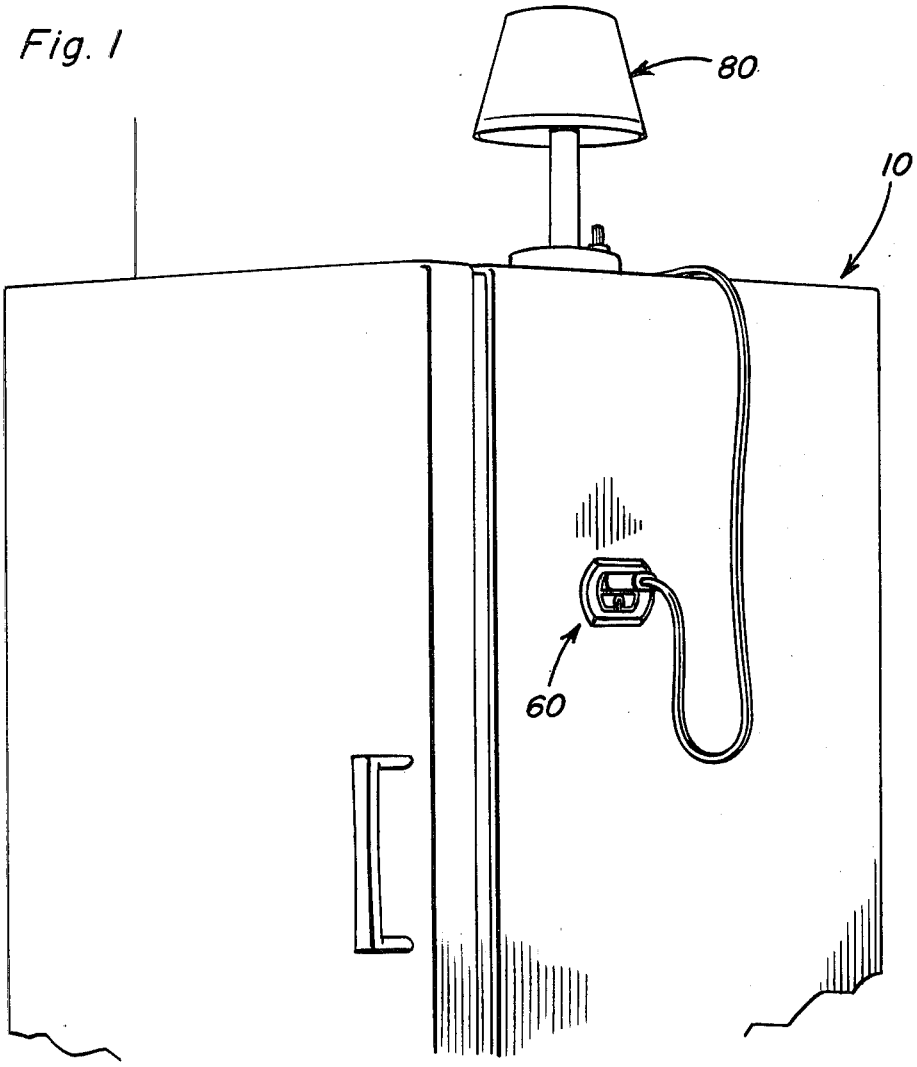
FIG. 1 is a perspective view of a lamp attached to a randomly activated socket of the present invention.
Figure 2:
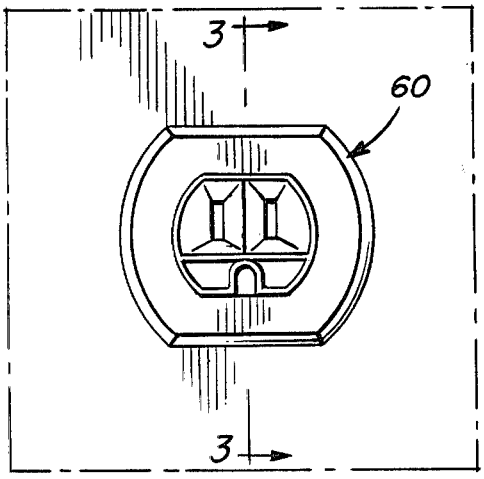
FIG. 2 is an enlarged view of the socket itself.
Figure 3:
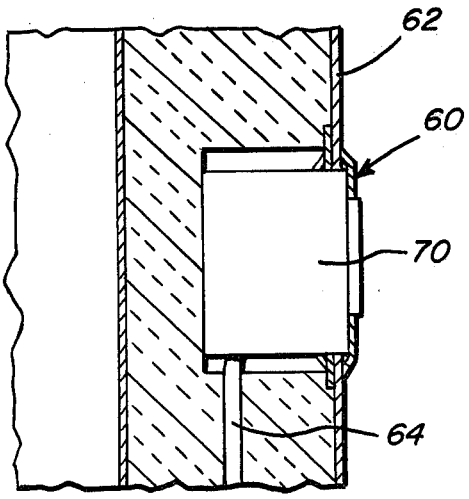
FIG. 3 is an elevational sectional view taken substantially along a plane passing through section line 3—3 of FIG. 2.

Now with reference to the drawings, a randomly activated socket incorporating the principles and concepts of the present invention will be described in detail. In the drawings, a standard home refrigerator is depicted by the reference numeral 10. The refrigerator 10 includes an evaporator section 12 and a condenser section 14 which are used in conjunction with compressor 16 to maintain the temperature in box 18 at a predetermined low temperature with respect to the surrounding room. Temperature control thermostat 20 is used in a conventional manner to set that predetermined temperature at any desired level.

Figure 4:
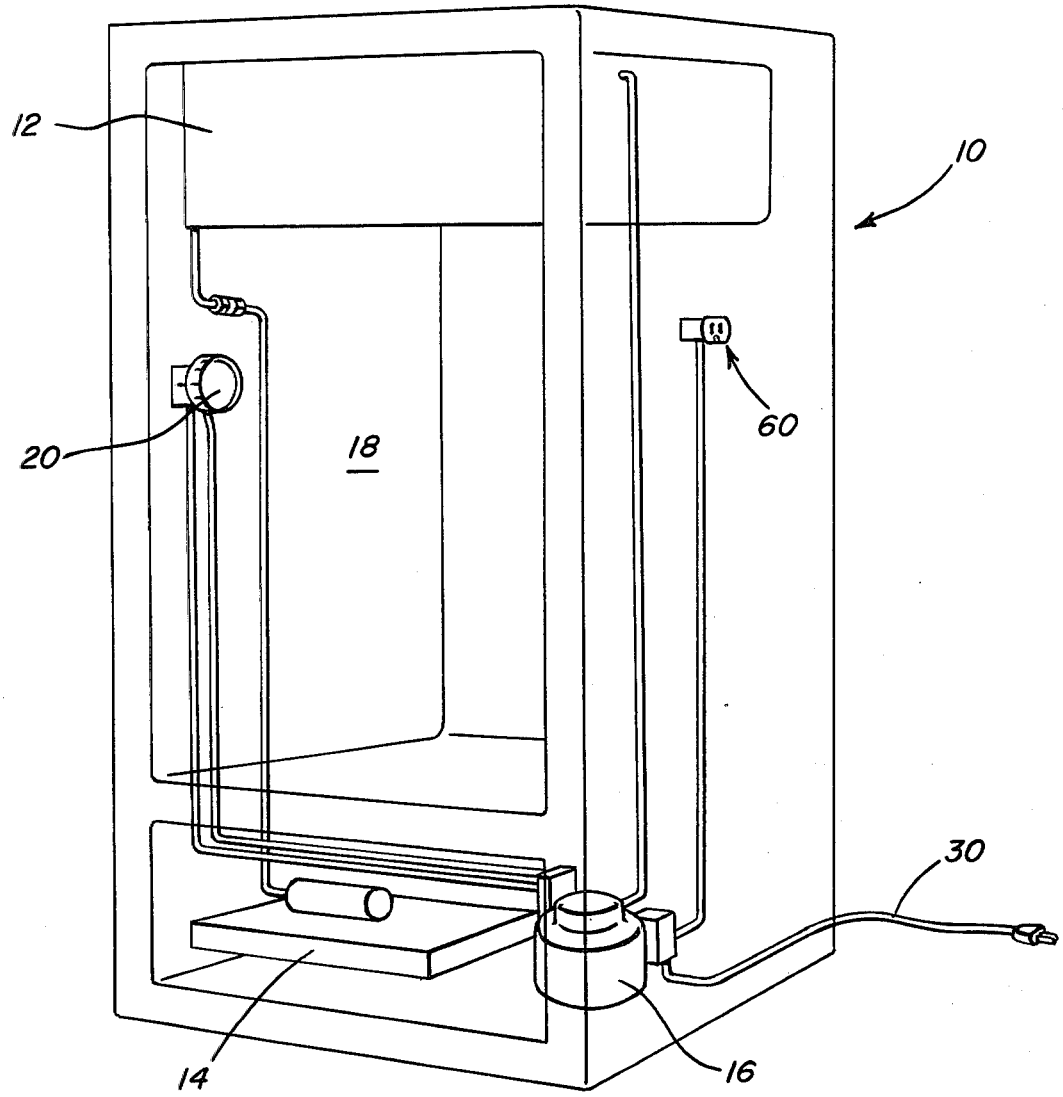
FIG. 4 is a part schematic view of the electrical system of the refrigerator with the socket incorporated therein.
Figure 5:
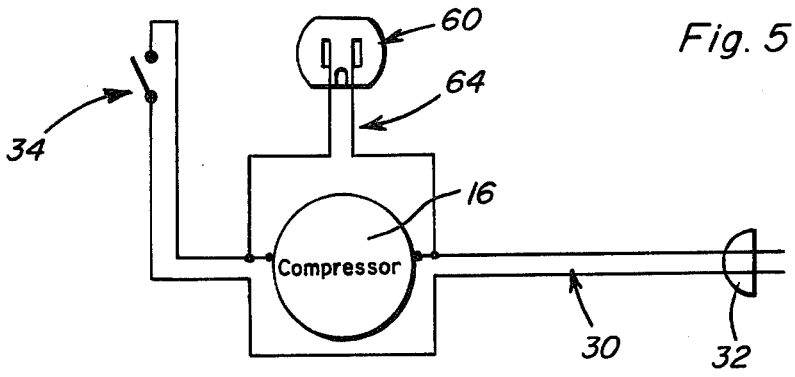
FIG. 5 is a schematic view of the connection of the socket of the present invention.

Compressor 16 is operated from a standard house current supply through lead 30 shown in FIGS. 4 and 5. Lead 30 contains a plug 32 which is adapted to fit into a standard home outlet. The motor of compressor 16 is connected in circuit with contacts 34 of a thermostatic unit disposed in the refrigerator for actuating the compressor upon the temperature within box 18 rising above the predetermined set temperature. Obviously, when contacts 34 close, current is supplied to the compressor 16 and the refrigeration cycle begins.

An electrical outlet 60 can be mounted in an exterior wall 62 of the refrigerator and is connected by standard electrical wiring 64 to the circuit shown in FIG. 5 in parallel with compressor 16. Thus, outlet 60 is activated each time the contacts of thermostat 34 close. The socket 60 can be any standardly available socket approved for use in a home. The socket is mounted in a standardly available connector box 70 which can be mounted on wall 62 by any suitable means.

Once socket 60 is mounted, a lamp as shown at 80 can be connected to the socket and will cycle along with compressor 16 in response to the opening and closing of contacts 34. In place of lamp 80, a radio, television or any other suitable appliance which is capable of producing visual or audible signals can be used. Obviously, the user can adjust the cycling of the lamp 80 by simply adjusting the level set by control 20. If the temperature within box 80 is commanded to be lowered by setting a lower temperature at control 20, the refrigerator and lamp will cycle more frequently. Conversely, if the control 20 is set at a higher temperature, the refrigerator and lamp will cycle less often.

It will be noted that by use of a refrigerator 10 for the actuation device or outlet 60, the outlet and connected lamp or other utilization device will be cycled during the summer, winter, day or night. Also, other combinations of elements can be utilized. For instance, several sockets 60 can be connected to the refrigerator 10 and standard day-night timers can be connected to the sockets. One timer can be set to allow current flow during the daytime and another timer can be set to allow current flow during the night. The night timer can be used to turn on and off a lamp while the day timer can be used to turn on or off a sound producing device such as a television or radio. Thus, not only is operation of these electrical appliances produced at random, but different appliances can be operated during different portions of the day or night to provide an even more realistic illusion of home occupancy.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A randomly activated electrical power supply means to which various electrical appliances, such as radios, televisions, lamps, etc., may be conveniently attached so as to be randomly activated at the same time said electrical power supply means is activated, thereby to give the illusion of a dwelling being occupied while its inhabitants are away, thus to dissuade burglars and other people from gaining unauthorized entry thereinto, said randomly activated electrical power supply means comprising:

refrigeration means having a refrigerator storage section, said refrigeration means including an electrically powered compressor means for supplying refrigerant to said refrigerated storage section so as to maintain a desired temperature therein;

thermostat means operably associated with said refrigeration means and being selectively operable to sense a temperature of said refrigerated storage section, said thermostat means further being operable to permit a supplying of operating electrical power to said compressor means when a sensed temperature of said refrigerated storage section rises above said desired temperature, said thermostat means being in series electrical communication with said compressor means so as to selectively control said supplying of said operating electrical power thereto; and electrical outlet means in parallel electrical communication with said compressor means so as to be concurrently provided with said operating electrical power when said compressor means is provided with said operating electrical power and having no operating electrical power provided thereto when said compressor means is not provided with operating electrical power, said operating electrical power supplied to said electrical outlet means being of a random nature inasmuch as such operating electrical power is supplied to said compressor means as a function of unpredictable temperature variations within said refrigerated storage section, thereby to randomly supply operating electrical power to said electrical appliances, such as said radios, televisions, lamps, and the like, which are selectively electrically connected to said electrical outlet means, said electrical outlet means being disposed on an exterior surface of said refrigeration means and facing outwardly from an outside wall of said refrigeration means so as to be accessible to exteriorly positioned electrical appliances.

* * * * *